US008141742B2

(12) United States Patent
Wolf

(10) Patent No.: US 8,141,742 B2
(45) Date of Patent: Mar. 27, 2012

(54) STORAGE CONTAINER COVER

(76) Inventor: Aaron Wolf, Savage, MN (US)

( * ) Notice: Subject to any disclaimer, the term of this patent is extended or adjusted under 35 U.S.C. 154(b) by 1091 days.

(21) Appl. No.: 12/011,600

(22) Filed: Jan. 28, 2008

(65) Prior Publication Data

US 2009/0188928 A1 Jul. 30, 2009

(51) Int. Cl.
*B65D 25/20* (2006.01)
*B65D 88/20* (2006.01)

(52) U.S. Cl. ..... 220/751; 220/1.5

(58) Field of Classification Search ..... 220/751, 220/212, 9.2, 1.5
See application file for complete search history.

(56) References Cited

U.S. PATENT DOCUMENTS

| | | | | |
|---|---|---|---|---|
| 3,799,384 | A * | 3/1974 | Hurkamp | 220/6 |
| 4,144,984 | A * | 3/1979 | Saunders | 220/1.5 |
| 4,684,034 | A * | 8/1987 | Ono et al. | 220/6 |
| 5,031,776 | A * | 7/1991 | Morgan, IV | 206/600 |
| 5,378,106 | A * | 1/1995 | Risley et al. | 414/608 |
| 5,941,405 | A * | 8/1999 | Scales et al. | 220/1.5 |
| 6,299,009 | B1 * | 10/2001 | Ryziuk et al. | 220/1.5 |
| 6,454,112 | B1 * | 9/2002 | Walters et al. | 220/1.5 |
| 7,017,741 | B1 * | 3/2006 | Williamson | 206/386 |
| 7,390,011 | B1 * | 6/2008 | Hem | 280/638 |
| 7,689,481 | B2 * | 3/2010 | Seagle et al. | 705/28 |
| 2009/0026197 | A1 * | 1/2009 | Chou et al. | 220/9.2 |

FOREIGN PATENT DOCUMENTS

FR 2695627 A1 * 3/1994

* cited by examiner

*Primary Examiner* — Anthony Stashick
*Assistant Examiner* — Niki Eloshway
(74) *Attorney, Agent, or Firm* — DL Tschida

(57) ABSTRACT

Several molded, hard plastic cover pieces and attached fabric or hard side wall assemblies are disclosed for mounting over a storage container. One cover piece provides raised channel rails that support a layered sub frame assembly. The sub frame secures fabric or plastic side wall assemblies to the cover piece. Fabric or expansible hinge pieces mount between fabric or plastic panels to provide flexible transitions to facilitate the mounting and removal of the cover piece and/or sidewall assembly. Cross pieces fitted to channel rails define lifting supports to permit attachment or removal of the cover piece from a wooden storage container. Truss pieces formed between channel pieces strengthen and control water runoff. Alternative cover pieces provide lifting towers, panels with tine receiving apertures or interconnected tension members.

20 Claims, 7 Drawing Sheets

STORAGE CONTAINER COVER

RELATED APPLICATION DATA

This is a non-provisional application of design application Ser. No. 29/268,905 filed Nov. 15, 2006.

BACKGROUND OF THE INVENTION

The present invention relates to commercial transport and storage containers and in particular to a hard cover and/or attached fabric or hard sidewall assembly that mounts to cover a wooden storage/transport container.

Wooden containers have long existed for storing and transporting all kinds and types of devices and commoditys. The shipping, trucking and warehousing industries use the containers to safely contain stored contents during shipping and storage. The containers can be constructed to any desired size and shape.

The multi-wall containers are typically constructed of wood with a top, sidewalls and a skid type bottom that accommodates handling with a forklift. For warehousing applications the containers are constructed of plywood in rectangular box shapes, for example, 5 feet wide, 8 feet deep and 7 to 8 feet high. One or more of the sidewalls are typically hinged to permit limited access to add or remove items. Stored contents are placed in the container and the container is stacked in a warehouse facility or located at other available storage space. The rectangular symmetry of the containers facilitates stacking and side-by-side placement.

Occasionally, the containers are moved to locations that aren't inherently weatherproof. In this instance, a sewn vinyl fabric cover is frequently mounted over the container. The cover is typically fitted over the container with the aid of a fork lift or ladder to provide the warehouse worker sufficient height to place the cover over the container and position it to drape over the sidewalls. The fabric cover can include detachable flaps to facilitate mounting and entry to the container at any available hinged walls. The fabric covers typically contain graphics and/or textual information.

Although fabric covers of the foregoing type weatherize the covered container and contents, the fabric covers are subject to relatively short lives due to the typical shipping/warehouse environment. Damage from tearing and abrasion most frequently occurs from the stresses of handling and contact with fork lifts and other containers.

The present invention was developed to provide a load bearing hard cap or cover for a storage container. The cover can be used alone or in combination with improved fabric and/or plastic sidewalls mounted to the cover. The cover is constructed to be accessible to handling from all sides with a forklift and provides a surface that vertically indexes to other containers. The cover can be fitted by itself to a container to substantially weatherize the container from nominal rain, snow and exposure to the elements. The cover can also be adapted to attach to fabric and/or plastic sidewalls having flexible hinged sections to define a complete weatherproof cover assembly.

SUMMARY OF THE INVENTION

It is a primary object of the invention to provide a hard cover or cap piece for a storage container that is adapted to handling with a forklift.

It is further object of the invention to provide a molded cover piece having tine receiving ports and supports whereby the cover piece can be raised.

It is further object of the invention to provide a cover piece that includes an integrated sub frame assembly to add rigidity to the cover piece.

It is an object of the invention to provide a sub frame assembly that fastens associated fabric or plastic sidewalls to the cover piece.

It is further object of the invention to provide a plastic sidewall assembly having flexible hinge portions.

It is further object of the invention to provide a plastic sidewall assembly having plastic hinge portions with folded webs (e.g. accordion shaped).

It is further object of the invention to provide a variety of alternative cover piece constructions.

The foregoing objects, advantages and distinctions of the invention are obtained in several alternative storage container cover assemblies. In a first construction, a molded, hard plastic cover provides a plurality of raised channels that separately support a sub frame assembly. Layered members of a wooden sub frame mount in and span the channels and secure associated fabric or plastic side walls to the cover piece. Cross pieces fitted to the cover piece define associated apertures and/or channels that are located to receive the tines of a fork lift or other lifting device to permit attachment or removal of the cover piece from a lower lying storage container. Truss pieces formed between channel pieces add strength and control water runoff.

Alternative sidewall assemblies constructed of fabric panels (e.g. vinyl), plastic or other hardened materials (e.g. pvc, nylon, ultra high molecular weight materials (UHMW) or composites) are also disclosed. Flexible hinge pieces mounted between the fabric and/or plastic panels provide flexible transitions that facilitate the mounting and removal of the cover piece and/or sidewall assembly. Flexible plastic hinge strips with folded webs (e.g. accordion shaped) are also disclosed that can be attached to the sidewall panels of a plastic walled assembly.

Still other objects, advantages, distinctions, constructions and combinations of individual features of the invention will become more apparent from the following description with respect to the appended drawings. Similar components and assemblies are referred to in the various drawings with similar alphanumeric reference characters. The description to each combination should therefore not be literally construed in limitation of the invention. Rather, the invention should be interpreted within the broad scope of the further appended claims.

DESCRIPTION OF THE PREFERRED EMBODIMENTS

Figure 1:
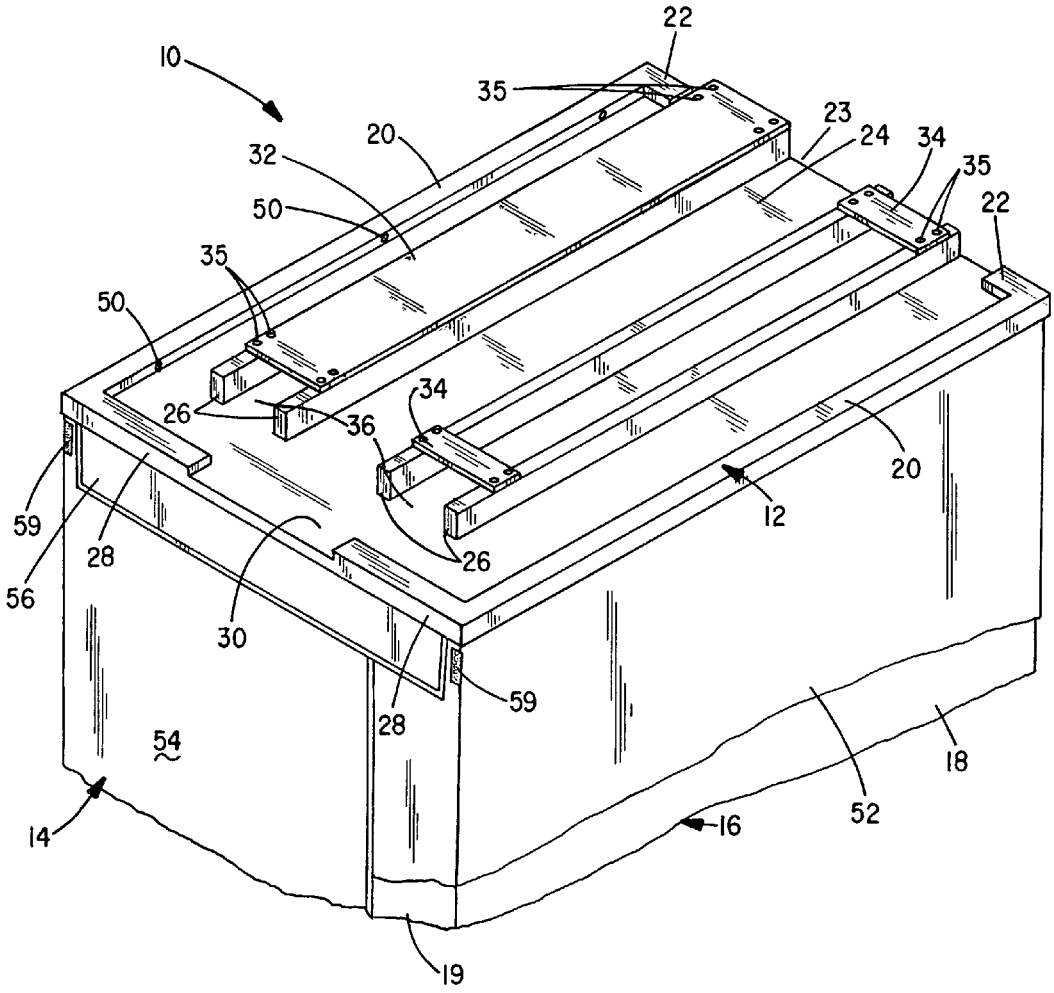
FIG. 1 is a perspective view showing front, left side and top views to an improved storage container cover having a molded (e.g. thermo formed) plastic cover piece and an attached fabric sidewall assembly.

With attention to the perspective view of FIG. 1, an improved storage container cover 10 having a molded plastic cover piece 12 and an attached fabric sidewall assembly 14 are shown. The cover 10 is mounted over a partially exposed typical storage container 16.

The container 16 is constructed of several wood panels (e.g. plywood) that define a top wall, depending sidewalls 18, a hinged door 19 and a floor/bottom (not shown). The container 16 is constructed in a rectangular box configuration and nominal size (e.g. 5 feet wide, 7 to 8 feet deep, and 7 to 8 feet high) compatible with various shipping vehicles and storage handling equipment. The floor/bottom is configured to accommodate lifting and transport of the container 10 with a conventional fork lift or may be secured to or contain a pallet-type frame. Similarly the cover piece 12 is adapted to fork lift handling.

The cover piece 12 is thermo formed from a suitable sheet stock plastic material (e.g. pvc nylon, UHMW or composite). The cover piece 12 provides right and left longitudinal peripheral side rails 20. Abbreviated corner rail sections 22 extend transversely from an aft end of the side rails 20. The rail sections 22 are interrupted by an open span or space 23 that exposes a flat region or top panel 24 and several raised longitudinal channel rails 26 that extend intermediate and parallel to the side rails 20. The channel rails 26 extend substantially the length of the top panel 24.

Corner rail sections 28 transversely extend from the fore end of the side rails 20 and expose a recessed end space 30. The end spaces 23 and 30 relieve water, snow, ice etc. that collects on the top panel 24. The rail sections 20, 22, 26 and 28 exhibit inverted, open-sided cavities of a desired shape (e.g. U or V shapes) when viewed on end or in transverse cross section, although could exhibit a variety of other open-sided shapes. The rail cavity spaces support strengthening devices discussed below. The outer flange of the rails 20, 22 and 28 depend below the top panel 24 to align and prevent lateral movement of the cover 10 relative to the lower lying container 19.

Full or partial length cross plates 32 and 34 are secured between and cover portions of adjoining channel rails 26 to define underlying lifting channels 36 that for example receive the tines of a fork lift or other lifting device. The plates 32 and 34 are secured with suitable fasteners 35 and support the weight of the storage container cover 10 when engaged by suitably spaced fork lift tines or other lifting devices. The arrangement of the plates 32 and 34 depict alternative forms of possible cover assemblies wherein both sets of the channel rails 26 are normally capped in similar fashion with the same cross plate(s) 32 or 34 such that both tine receiving lifting channels 36 are either fully or partially enclosed.

Figure 2:
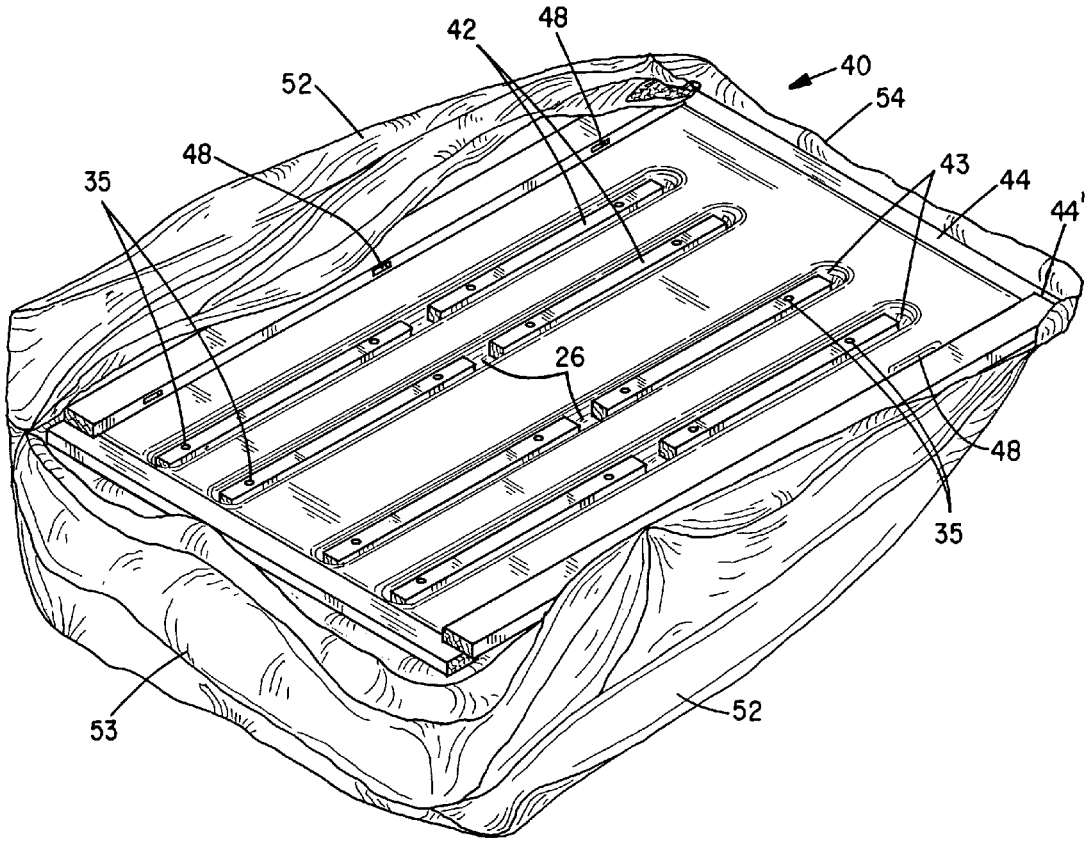
FIG. 2 is a perspective view shown in exploded assembly of a wooden sub frame assembly that attaches to the cover piece and clamps the sidewall assembly to the storage container cover of FIG. 1.

The rails 20, 22, 26 and 28 are sized to support and contain the members of a sub frame assembly 40 shown at FIG. 2. With attention to FIG. 2, the sub frame 40 is presently constructed of wooden 2×4's or stiffeners 42 and 44 that are contained within and below the rails 20, 22, 26, and 28. The stiffeners 42 mount in cavity spaces 43 at the channel rails 26 and are secured in place with the fasteners 35 that extend through the cross plates 32 or 34, the top panel 24, and stiffeners 42. The stiffeners 42 provide rigidity and distribute the weight of any overlying storage container 16 that might be mounted on top of the cover piece 12 and covered container 16. The stiffeners 42 and 44 can be constructed of other materials and may extend only partially along the rail cavity spaces. Cross braces or truss members may also be molded into the cavity spaces in honeycomb fashion.

The stiffeners 44 circumscribe the periphery of the cover piece 12 and fasten to the rails 20, 22 and 28. Overlapped stiffeners 44' mount to the stiffeners 44. The stiffeners 44 and 44' clamp fabric panels 52, 53 and 54 of the sidewall assembly 14 to the cover piece 12. Slots 48 are formed into the overlapped stiffeners 44 and 44' and receive blind fasteners 50 that extend through the sides of the side rail channels 20.

With attention to FIGS. 1 and 2 and the sidewall assembly 14, side, end and door wall panels 52, 53 and 54 are fastened to the cover 12 and drape over the container 16. The door wall panel 54 is constructed with a top edge panel 56 that transversely spans the front of the container 16 and overlaps the hinged door 19. Mating hook and loop tabs 59 are appropriately located to the door hinge panel 56 and door panel 54. The tabs 59 retain the door panel 54 in a closed condition and to the adjoining side wall panel 52 in a folded open condition when the container door 19 is open.

The sidewall assembly 14 is can be constructed of a variety of different weather and UV resistant fabrics, canvas and/or coated materials. Such materials are sufficiently flexible to facilitate fitting the assembly 17 over the container 16 as the cover piece 12 is located and the panels 52, 53 and 54 are aligned to the container 16. Although fabric is suitable for many applications and provides cost advantages, many applications are better served with a hard side wall assembly 60 such as shown in FIGS. 3 and 4.

Figure 3:
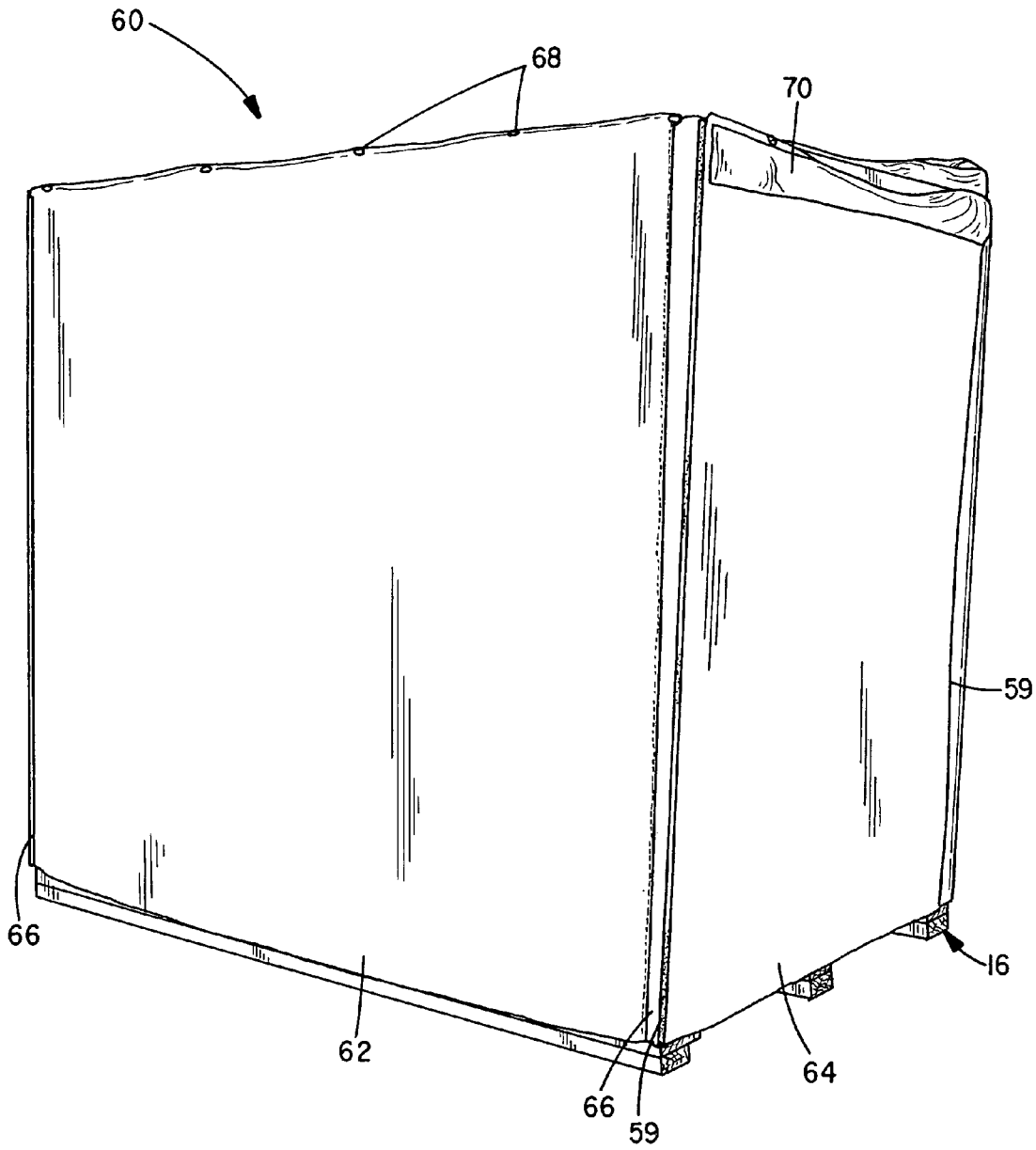
FIG. 3 is a perspective view showing a composite plastic and fabric sidewall assembly that attaches to the storage container cover piece.

The assembly 60 of FIG. 3 provides hard side and end panels 62 and 64. The panels 62 and 64 are formed from suitable sheet stock materials (e.g. pvc, plastic, ribbed plastic, ultra high molecular weight materials (UHMW), or composites) and typically exhibit a thickness in the range of 0.1 to 0.2 inches. The panels 62 and 64 are interconnected at aligned edges with flexible corner strips 66. The strips 66 when constructed of fabric provide flexion to facilitate fitting the assembly 14 over a container 16. The top edges of the side panels 62 and the end panels 64 or attached stripping 66 are secured to the sub frame assembly 40 with suitable fasteners 68. Where one of the panels 64 is to serve as a door cover, a fabric hinge piece 70 is secured to the door panel 64 and lengths of hook and loop fastener material 59 are attached to the panel 64 and the adjoining hinge strips 66. The front panel 64 can be detached and displaced to provide access to a covered door 19.

Figure 4:
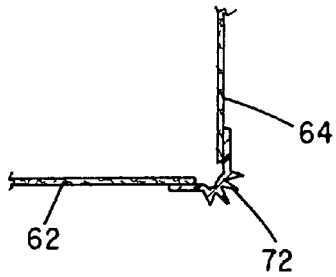
FIG. 4 is a partial top plan view to a corner of a plastic walled sidewall assembly with accordion shaped hinge pieces.

Although fabric edge/hinge strips 66 perform satisfactorily, FIG. 4 shows a strip of an alternative expansible stripping piece 72 having several folded webs that exhibit an accordion-shaped profile and that interconnect the panels 62 and 64. Tabs of hook and loop material 59 can again be used at the edge strips 72 in combination with a door covering panel 62 or 64 to selectively expose the door 20. The stripping pieces 72 can also be bonded or welded to the panels 62 and 64 with adhesives, thermal or sonic welding, mechanically as by sewing, or with fasteners. The expansible stripping pieces 72 can also exhibit other folded profiles, but desirably expand and contract during the fitting of the cover 60.

Figure 5:
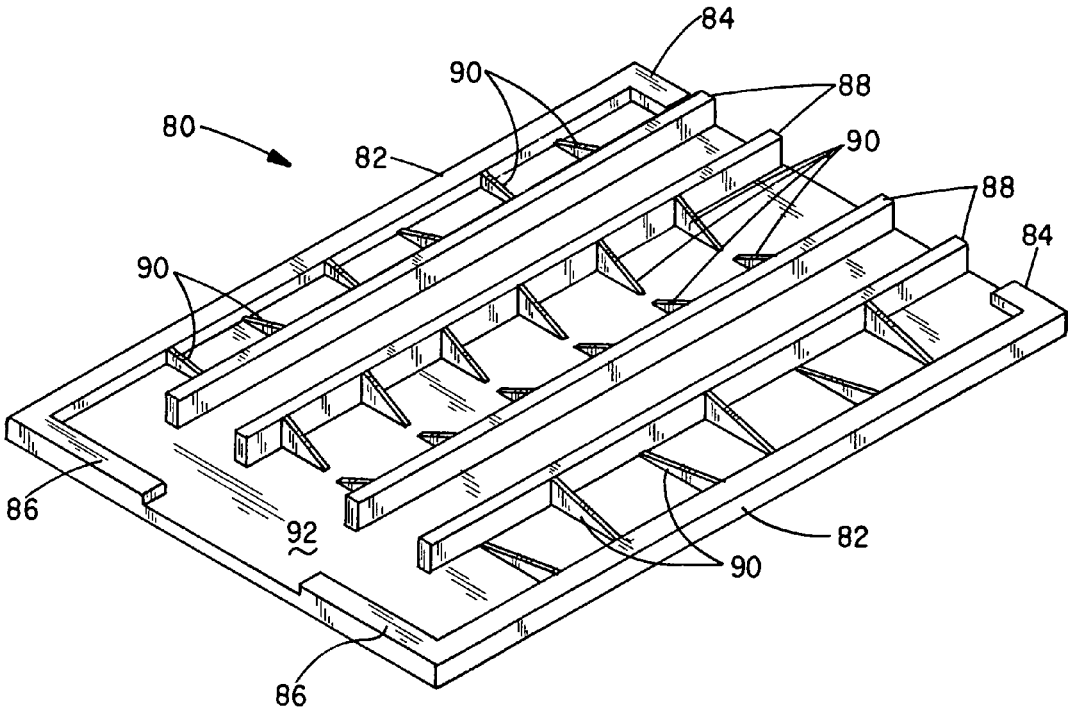
FIG. 5 is a perspective view showing front, left side and top views to the improved storage container cover of FIG. 1 with molded truss supports projecting from the channels.

With attention to FIG. 5, an alternative cover piece 80 is shown in perspective view. The cover piece 80 provides side and corner rail sections 82, 84 and 86 that substantially circumscribe intermediate channel rails 88. Right triangular trusses 90 project from a top panel piece 92 and are aligned to stabilize and enhance the load bearing capacities of the rails 82 and 88. The rails 88 and 26 and covers 10 and 80 are constructed to support loads of 2000 pounds and more. The trusses 90 are organized to channel water and ice off the cover 80.

Figure 6:
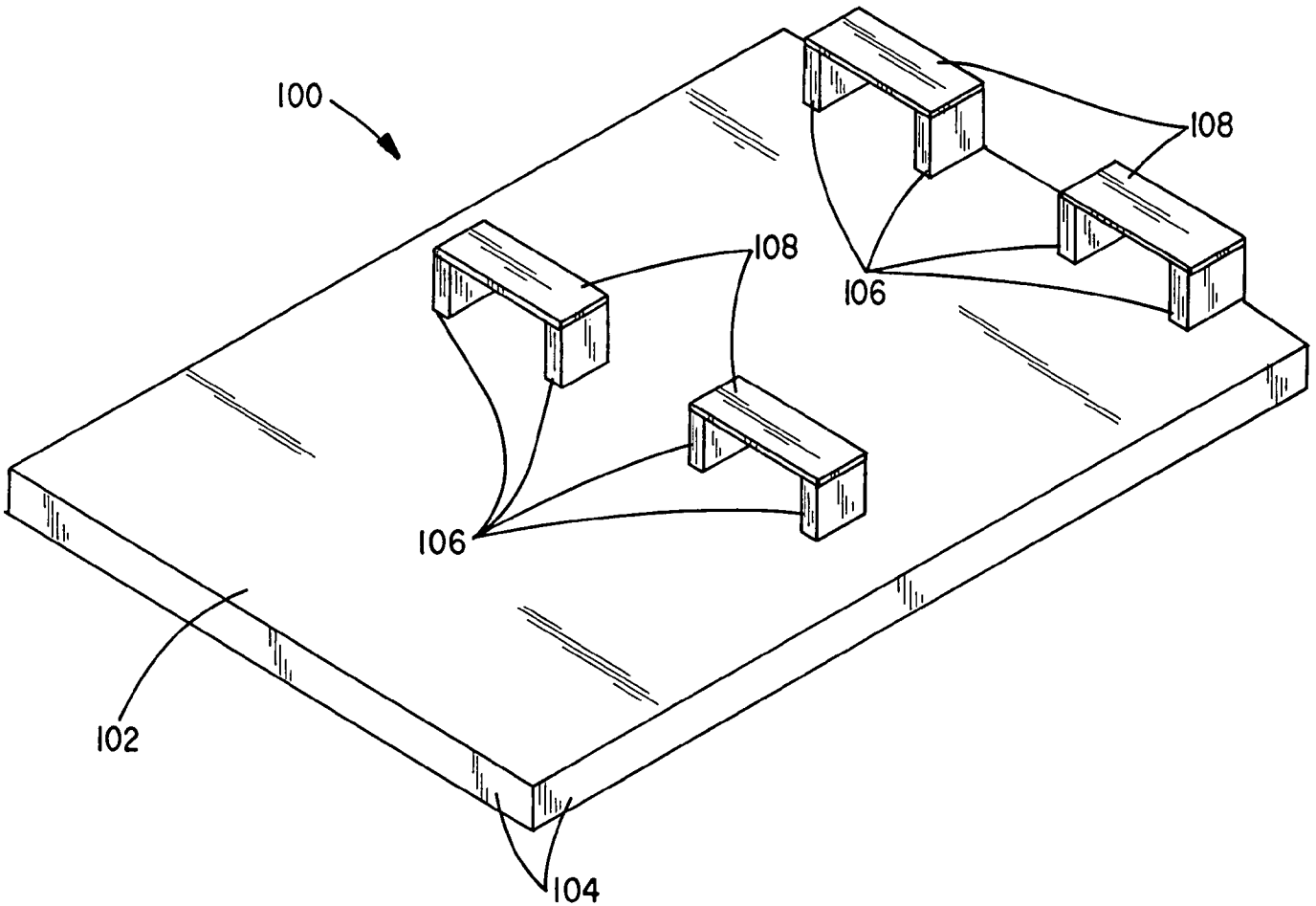
FIG. 6 is a perspective view showing an alternative flat-top storage container cover having raised tine receiving standoffs.

FIG. 6 depicts yet another molded cover piece 100 that provides a flat top panel piece 102 and depending peripheral flanges or sidewalls 104. Fastened or formed to the top panel 102 are multiple raised towers 106. Cross pieces 108 interconnect the towers 106 to facilitate the lifting of the cover piece 100. The towers 106 are typically formed with the cover piece 100 and may exhibit a hollow cavity space. Alternatively, solid blocks of suitable material can be attached to the top panel 102 with a variety of threaded fasteners, rivets, or can be bonded to the top panel 102 with adhesives, welding or other techniques. The towers 106 project from the top panel 102 sufficiently to receive the tines of a fork lift or other lifting device inserted between the panel 102 and the cross pieces 108.

The panel and sidewall pieces 102, 104 and towers 106 are constructed of high density plastics, although a variety of weather and UV resistant materials can be used. The cover piece 100 as well as the covers 10 and 80 can be formed using a variety of techniques, including machining, vacuum forming, roto-molding, and blow molding, among other processes.

Figure 7:
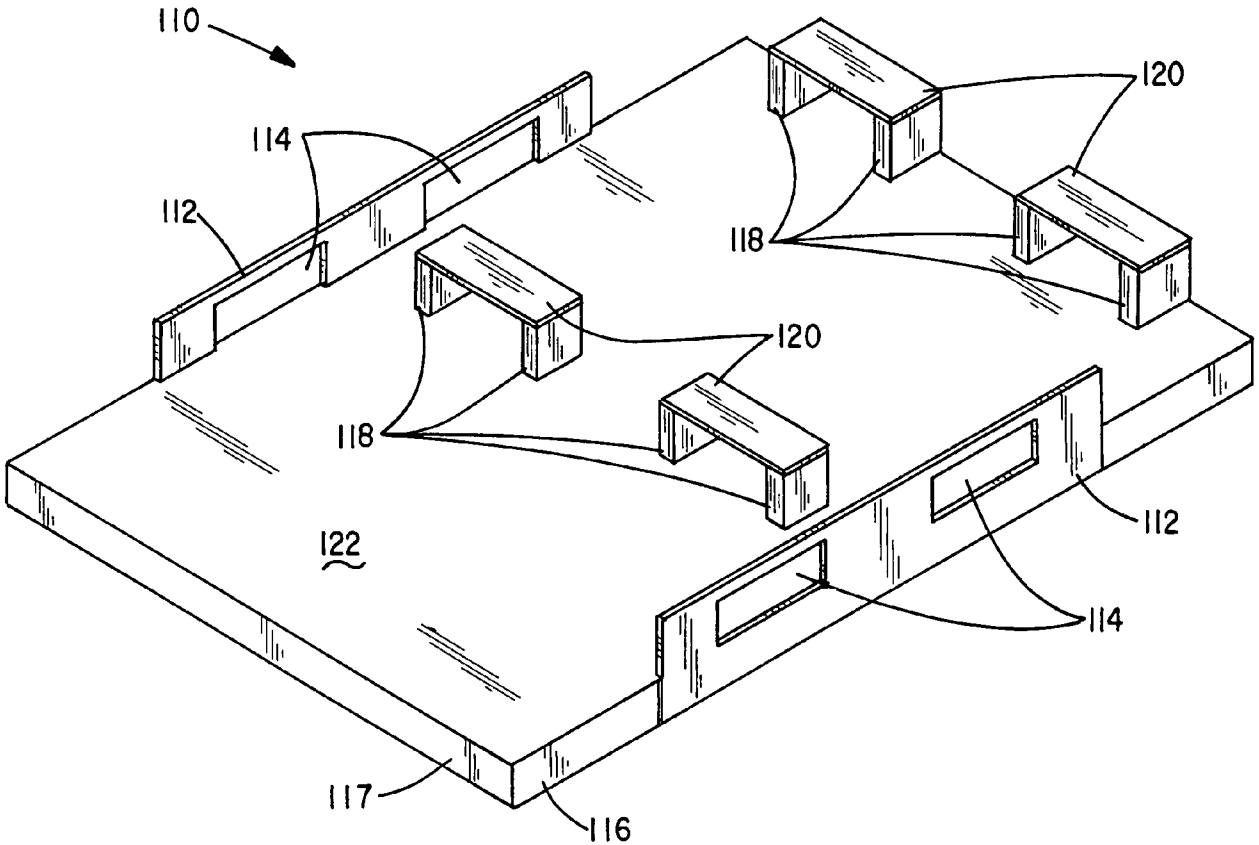
FIG. 7 is a perspective view showing an alternative flat-top storage container cover having raised tine receiving standoffs and side mounted tine receiving support plates.

FIG. 7 shows another alternative container cover piece 110 wherein side panels 112 having apertures 114 are fastened, bonded or integrally formed to side and/or end walls 116 and 117 of the cover piece 110. Several intermediate raised towers 118 and cross pieces 120 project from a top panel 122. The towers 118 and/or panels 112 project from the top panel 122 sufficiently to receive the times of a fork lift or other lifting device inserted between the panel 122 and the cross pieces 120 or through the apertures 114. The towers 118 and/or panels 112 are located to facilitate access to grip the cover piece 110 from either a longitudinal end upon supporting fork lift tines through the spaces between the panel 122 and cross pieces 120 or at a side by inserting the tines through the oppositely aligned apertures 114.

Figure 8:
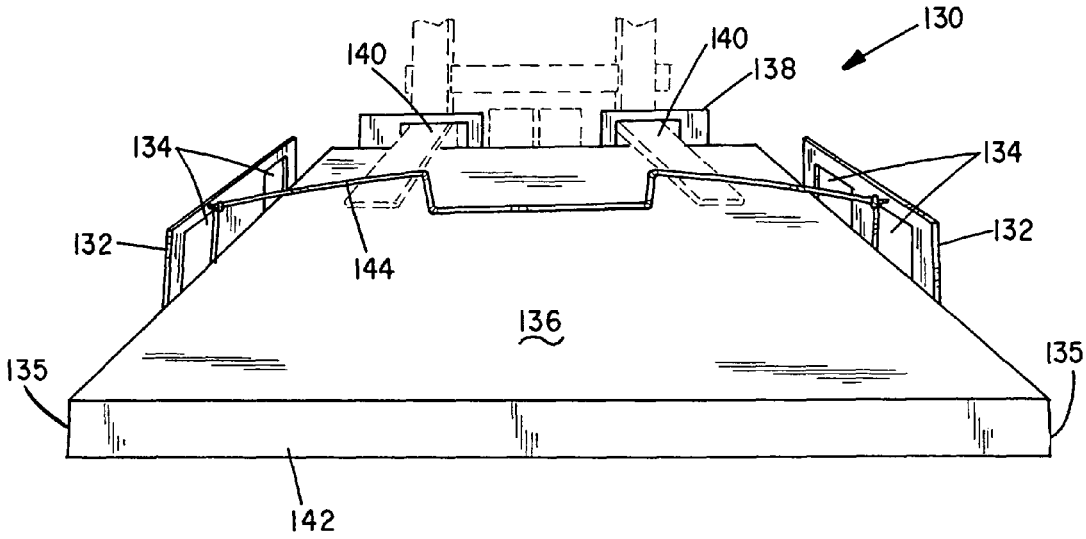
FIG. 8 is a perspective view showing an alternative flat-top storage container cover having side and end mounted tine receiving support plates and cross straps.

FIG. 8 shows still another alternative container cover piece 130 having side panels 132 with apertures 134 that mount to side walls 135 and extend above a thermo formed top panel 136. End wall panels 138 with apertures 140 mount to an end wall 142. The panels 132 and 138 can be integrally formed with the top panel 136 or can be fastened or bonded to the depending side and end wall panels 135 and 142 that depend or project downward about the circumferential periphery of the panel 136.

Suspended between the side panels 132 is a tension member 144 that overlies the top panel 136. The member 140 can be constructed of a variety of flat or rod stock materials, rope or other stranded or flexible materials. The tension member 144 in combination with the end panel 138 supports the weight of the cover piece 130 when raised with a fork lift. The cover piece 130 is raised or lowered from a longitudinal end upon supporting fork lift tines through the apertures 140 and beneath the member 144 or from the sides upon inserting the tines through the oppositely aligned apertures 134.

Although not shown, it is to be appreciated the covers 100, 110 and 130 can be used alone or can include a sub frame similar to the assembly 40. The members of such a sub-framework secure an appropriate side wall assembly 14 to the covers 100, 110 or 130 and strengthen the covers to withstand any overlying, supported container 16.

While the invention has been described with respect to a presently preferred and several alternative assemblies and considered improvements, modifications and/or alternatives thereto, still other assemblies and combinational arrangements may be suggested to those skilled in the art. The foregoing description should therefore be construed to include all those embodiments within the spirit and scope of the following claims.

What is claimed is:

1. A storage container cover comprising:

a) a panel including a plurality of rails, wherein each rail projects from a flat planar surface of said panel and exhibits an open cavity space exposed at the opposite side of the flat planar surface;

b) a sub frame comprised of a plurality of frame members, wherein said frame members mount in the open cavity spaces of said rails, c) a plurality of flexible walls mounted to said panel to depend downward and drape about and enclose a space beneath said panel wherein a storage container can be positioned; and d) a plurality of members displaced about a top surface of said panel defining open passageways to receive and contain a lifting device, whereby the cover can be raised and lowered.

2. A storage container cover as set forth in claim 1 including a plurality of members spanning between adjacent rails to define said passageways to receive lifting tines.

3. A storage container cover as set forth in claim 1 wherein said flexible walls comprise a fabric and wherein a plurality of fasteners are arrayed about surfaces of the fabric walls to detachably fasten and hinge to at least one adjoining wall.

4. A storage container cover as set forth in claim 1 wherein said flexible walls comprise a plastic sheathing and wherein a plurality of fasteners are arrayed about surfaces of the plastic walls to detachably fasten and hinge to at least one adjoining wall.

5. A storage container cover as set forth in claim 4 wherein adjoining pairs of said plastic walls are coupled together with fabric members.

6. A storage container cover as set forth in claim 4 wherein adjoining pairs of said plastic walls are coupled together with elongated hinge members that exhibit a plurality of folded webs when viewed on end.

7. A storage container cover as set forth in claim 1 wherein a plurality of slots are formed in said frame members such that fasteners mounted through said rails and retained in said slots secure said frame members to said panel.

8. A storage container cover as set forth in claim 1 wherein said flexible walls comprise a fabric coupled to the rails and wherein a plurality of fasteners are arrayed about said fabric walls to detachably fasten and hinge at least one wall to the other walls.

9. A storage container cover as set forth in claim 1 wherein said passageways comprise a first and a second member of said plurality of members exhibiting at least one aperture and wherein the apertures of said first and second members are aligned to receive lifting tines.

10. A storage container cover as set forth in claim 9 wherein said passageways comprise a plurality of members mounted to span said rails to define channel spaces between the rails having at least one open end aligned to receive lifting tines.

11. A storage container cover comprising a) a panel including a plurality of rails, wherein each rail projects from a top surface of said panel and exhibits an open cavity space exposed at a bottom surface of the panel, wherein said plurality of rails comprise a plurality of edge rails projecting above peripheral edges of the panel, and a plurality of interior rails displaced interiorly of the edge rails;

b) a sub frame comprised of a plurality of frame members, wherein the frame members mount in the open cavity spaces of the rails;

c) a plurality of flexible walls mounted to said panel to depend downward and drape about and enclose a space beneath said bottom surface wherein a storage container can be positioned; and d) a plurality of members spanning between interior rails to define covered passageways between said interior rails to receive and contain lifting tines.

12. A storage container assembly comprising:

a) a container having a plurality of rigid side, top and bottom walls arranged to enclose a storage space; and b) a cover piece comprising:

i) a panel including a plurality of rails, wherein each rail projects from a top surface of said panel and exhibits an open cavity space exposed at a bottom surface of the panel, wherein said plurality of rails comprise a plurality of edge rails projecting above peripheral edges of the panel, and a plurality of interior rails displaced interiorly of the edge rails;

ii) a sub frame comprised of a plurality of frame members, wherein the frame members mount in the open cavity spaces of the rails;

iii) a plurality of flexible walls mounted to said edge rails to depend downward and drape about and enclose a space beneath said bottom surface and wherein said storage container can be positioned; and iv) a plurality of members spanning between interior rails to define open passageways between said interior rails to receive and contain lifting tines.

13. A storage container assembly as set forth in claim 12 wherein a plurality of slots are formed in said frame members such that fasteners mounted through rails of said plurality of rails and retained in said slots secure said frame members to said panel.

14. A storage container assembly as set forth in claim 12 wherein said flexible walls comprise a fabric and wherein a plurality of fasteners are arrayed about surfaces of the fabric walls to detachably fasten and hinge to at least one adjoining wall.

15. A storage container assembly as set forth in claim 12 wherein said flexible walls comprise a plastic sheathing and wherein a plurality of fasteners are arrayed about surfaces of the plastic walls to detachably fasten and hinge to at least one adjoining wall.

16. A storage container assembly as set forth in claim 15 wherein adjoining plastic walls are coupled together with elongated webbed hinge members.

17. A storage container cover comprising a a) a panel circumscribed by a plurality of edge flanges that orthogonally depend from peripheral edges of the panel;

b) a drape comprised of a plurality of fabric walls coupled to the edge flanges to depend downward from said panel and drape about and enclose a space wherein a storage container can be positioned and wherein a plurality of fasteners are arrayed about the fabric walls to detachably fasten and hinge to at least one adjoining wall; and c) a plurality of members mounted on a top surface of said panel defining a plurality of open passageways and wherein said members are displaced and aligned to receive and contain a lifting device, whereby the cover can be raised and lowered.

18. A storage container cover as set forth in claim 17 wherein said panel includes a frame members embedded in said panel.

19. A storage container cover comprising:

a) a panel circumscribed by a plurality of edge flanges that orthogonally depend from peripheral edges of the panel;

b) a sub frame comprised of a plurality of frame members coupled to the periphery of said panel;

c) a drape comprised of a plurality of fabric walls coupled to the edge flanges to depend downward from said panel and drape about and enclose a space wherein a storage container can be positioned and wherein a plurality of fasteners are arrayed about the fabric walls to detachably fasten and hinge to at least one adjoining wall; and d) a plurality of members mounted to a top surface of said panel defining a plurality of open passageways and wherein said members are displaced and aligned to receive and contain a lifting device, whereby the cover can be raised and lowered.

20. A storage container cover comprising a a) a panel circumscribed by a plurality of flanges that orthogonally depend from peripheral edges of the panel; and b) a plurality of plate members coupled to said flanges and projecting above a top surface of said panel, wherein said plate members include a plurality of apertures, and wherein said apertures are aligned to receive lifting tines of a lifting device, whereby the cover can be raised and lowered.

* * * * *